US007441552B1

(12) United States Patent
Matsui et al.

(10) Patent No.: US 7,441,552 B1
(45) Date of Patent: Oct. 28, 2008

(54) IGNITION COIL APPARATUS FOR AN INTERNAL COMBUSTION ENGINE

(75) Inventors: Tomohito Matsui, Aioi (JP); Nobuyuki Sawazaki, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 0 days.

(21) Appl. No.: 11/853,360

(22) Filed: Sep. 11, 2007

(30) Foreign Application Priority Data

May 11, 2007 (JP) ..... 2007-126847

(51) Int. Cl.
*F02P 3/02* (2006.01)

(52) U.S. Cl. ..... 123/634; 123/635

(58) Field of Classification Search ..... 123/634, 123/635

See application file for complete search history.

(56) References Cited

U.S. PATENT DOCUMENTS 6,543,430 B2 * 4/2003 Moga et al. ..... 123/634
6,776,147 B2 * 8/2004 Tsunenaga et al. ..... 123/635
2004/0123852 A1 * 7/2004 Tsunenaga et al. ..... 123/635

FOREIGN PATENT DOCUMENTS

JP 2002-48043 A 2/2002

* cited by examiner

*Primary Examiner*—Erick Solis
(74) *Attorney, Agent, or Firm*—Sughrue Mion, PLLC

(57) ABSTRACT

The rotation of an ignition coil apparatus upon mounting thereof on an internal combustion engine is prevented with a simple structure, and the efficiency of mounting the ignition coil apparatus on the internal combustion engine is improved. A high voltage tower is formed integrally with a case main body having a transformer received therein, and holds a high voltage output terminal therein. A cylindrical plug boot has its one end attached to the high voltage tower. The plug boot is inserted into a plug hole in an internal combustion engine main body whereby the ignition coil apparatus is mounted on the internal combustion engine main body through a head cover having upstanding wall portions. A pair of protrusions for restricting the rotation of the casing main body around an axis of the plug hole are formed on a surface of the casing main body in opposition to the wall portions.

4 Claims, 7 Drawing Sheets

IGNITION COIL APPARATUS FOR AN INTERNAL COMBUSTION ENGINE

BACKGROUND OF THE INVENTION

1. Field of the Invention

The present invention relates to an ignition coil apparatus for an internal combustion engine which applies a high voltage for generation of a spark discharge to a spark plug for each engine cylinder.

2. Description of the Related Art

As a conventional mounting structure for an ignition coil apparatus for an internal combustion engine, there has been known one in which a coil case with a part of a core received therein has a thick wall portion protruding toward an internal combustion engine side, and the internal combustion engine has a rotation limiting protrusion that limits or restricts the rotation of the ignition coil apparatus in the same direction as that in which a bolt engaged with the thick wall portion is able to rotate (see, for example, a first patent document: Japanese patent application laid-open No. 2002-48043 (claim 7)).

That is, the bolt is inserted into a through hole formed in the core which is located outside the coil case, so that the rotation of the ignition coil apparatus upon tightening the core against a mounting seat is prevented by the engagement of the rotation limiting protrusion with the thick wall portion.

In the mounting structure of the conventional ignition coil apparatus for an internal combustion engine, in order to limit or restrict the rotation of the ignition coil apparatus upon mounting thereof on the internal combustion engine, it is necessary for a head cover of the internal combustion engine to provide with a special protrusion structure, which deteriorates workability or working efficiency of the head cover, thus posing a problem that the cost of manufacture becomes high.

SUMMARY OF THE INVENTION

Accordingly, the present invention is intended to obviate the problems as referred to above, and for its object to obtain an ignition coil apparatus for an internal combustion engine which is capable of limiting or restricting the rotation thereof upon mounting the ignition coil apparatus onto the internal combustion engine with a low cost and simple structure without spending special man-hours on a head cover.

Bearing the above object in mind, an ignition coil apparatus for an internal combustion engine according to the present invention includes ①.

According to the ignition coil apparatus for an internal combustion engine of the present invention as constructed above, the rotation of the ignition coil apparatus upon mounting thereof on the internal combustion engine can be prevented with the use of a low cost and simple structure without spending special man-hours on the head cover.

The above and other objects, features and advantages of the present invention will become more readily apparent to those skilled in the art from the following detailed description of preferred embodiments of the present invention taken in conjunction with the accompanying drawings.

DESCRIPTION OF THE PREFERRED EMBODIMENTS

Figure 1:
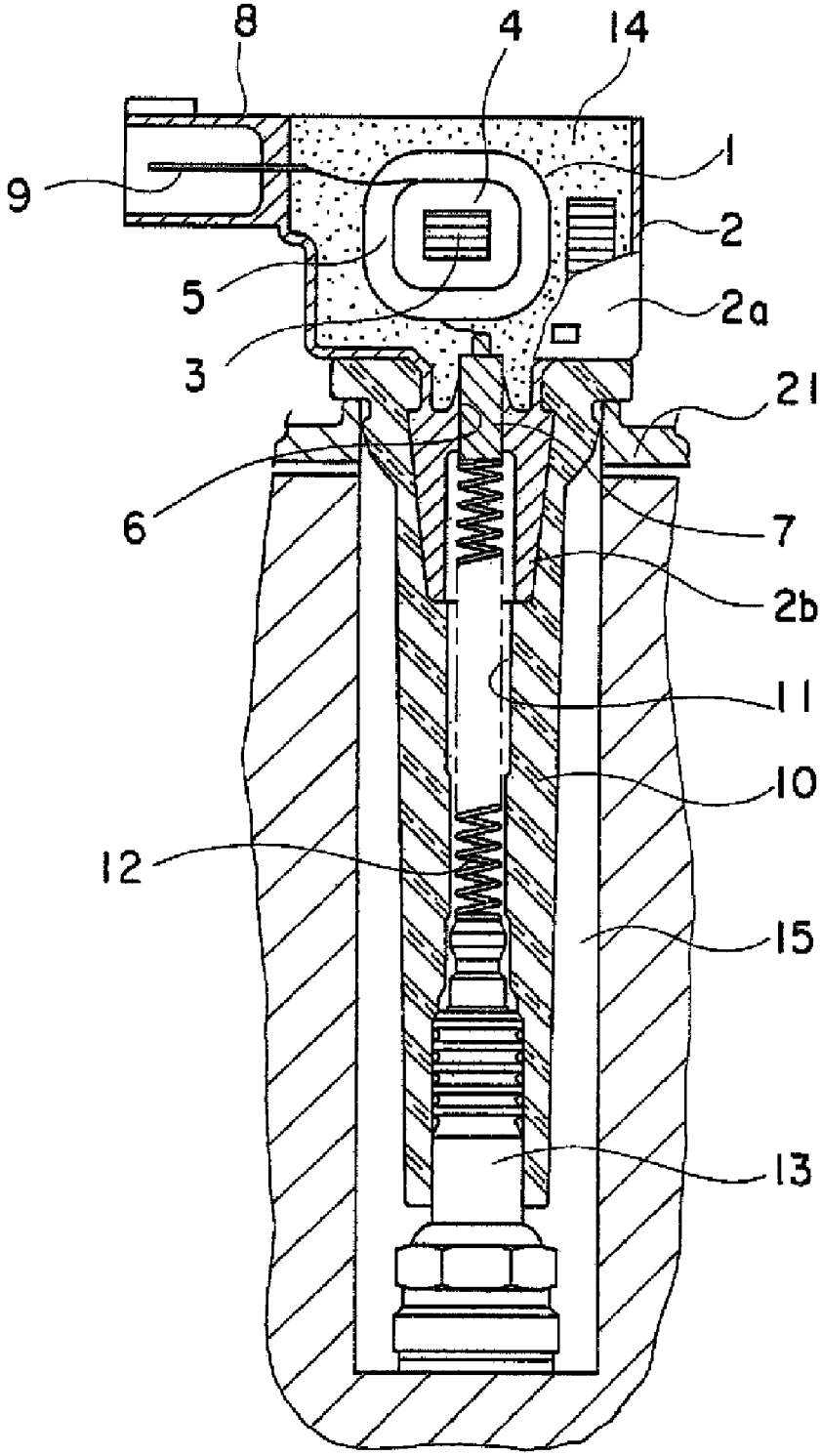
FIG. 1 is a cross sectional front elevational view showing an ignition coil apparatus for an internal combustion engine according to a first embodiment of the present invention.

Now, preferred embodiments of the present invention will be described in detail while referring to the accompanying drawings. Throughout individual figures, the same or corresponding members or parts are identified by the same reference numerals and characters.

Embodiment 1

Figure 2:
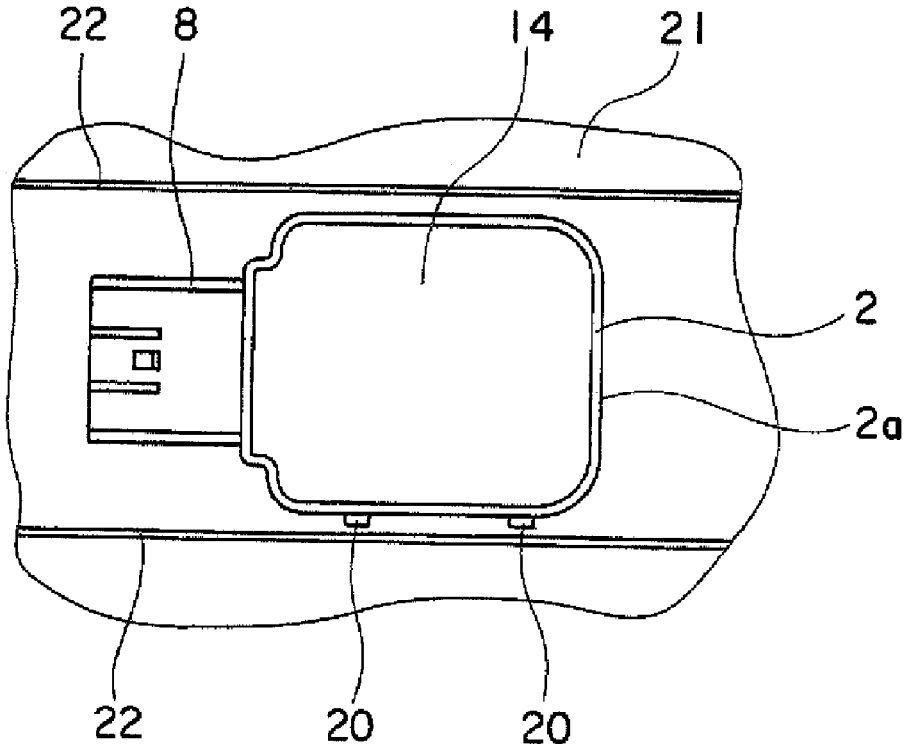
FIG. 2 is a plan view showing the ignition coil apparatus for an internal combustion engine in FIG. 1.
Figure 3:
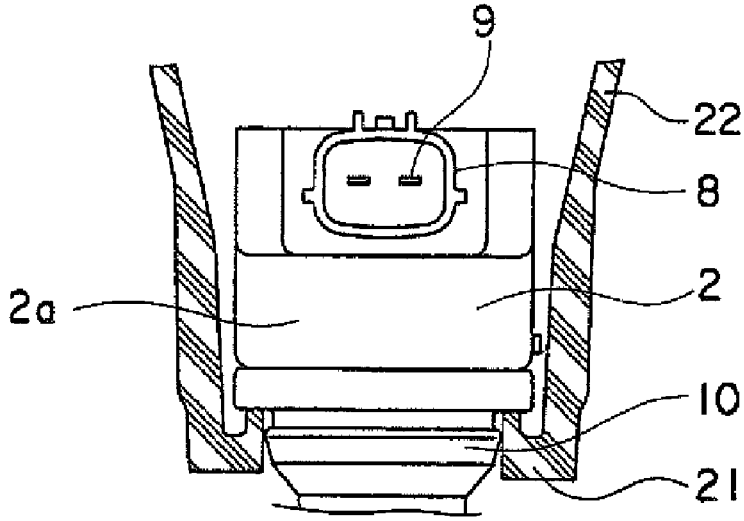
FIG. 3 is a partial left-side view of the ignition coil apparatus for an internal combustion engine in FIG. 1.

FIG. 1 is a cross sectional front elevational view that shows an ignition coil apparatus for an internal combustion engine (hereinafter abbreviated as an ignition apparatus) according to a first embodiment of the present invention. FIG. 2 is a plan view showing the ignition apparatus in FIG. 1, and FIG. 3 is a partial left-side view of the ignition coil apparatus in FIG. 1.

This ignition apparatus has a transformer 1 received in a case 2. The transformer 1 has an iron core 3 that is formed of a plurality of thin steel plates laminated one over another, and a primary winding 4 and a secondary winding 5 that are wound around the iron core 3. The case 2 is composed of a case main body 2*a* that receives the transformer 1 electrically insulated and fixedly attached thereto by an insulating resin 14, and a high voltage tower 2*b* that is formed integrally with the case main body 2*a* and has an opening portion 6 placed in communication with the case main body 2*a*. A pair of protrusions 20 are formed on one surface of the case main body 2*a*.

A connector 8 having a low voltage input terminal 9 is formed integrally with the case main body 2*a* at a side surface thereof.

A high voltage output terminal 7 for outputting a high voltage generated upon interruption of an excitation current flowing through the primary winding 4 to the outside is fitted into the opening portion 6 of the high voltage tower 2*b*.

A plug boot 10 made of rubber is fitted onto the high voltage tower 2*b* of the case 2. The plug boot 10 has a through hole 11 formed therethrough along the central axis thereof. A spring 12, being a conductor electrically connected to a spark plug 13, is arranged in the interior of the high voltage tower 2*b* and in the through hole 11 so as to urge the spark plug 13.

The ignition apparatus of the above-mentioned construction is mounted on an internal combustion engine that comprises an internal combustion engine main body 16 and a head cover 21 attached to the internal combustion engine main body 16.

That is, the plug boot 10 is inserted into the plug hole 15 formed in the internal combustion engine main body 16, whereby the ignition apparatus is mounted on the internal combustion engine main body 16 through the head cover 21.

The head cover 21 has a pair of wall portions 22 formed to upstand therefrom at its opposite sides in opposition to each other. When the ignition apparatus is mounted on the internal combustion engine main body 16, the pair of protrusions 20 formed on the case main body 2*a* are arranged in opposition to the wall portions 22.

Now, reference will be made to an assembly procedure for the coil apparatus as constructed above.

First of all, the low voltage input terminal 9, the high voltage output terminal 7 and the transformer 1 are electrically connected to one another.

Then, the high voltage output terminal 7 is press-fitted into the opening portion 6 of the high voltage tower 2*b*, whereby the transformer 1 is built into the case main body 2*a*.

Subsequently, the molten insulating resin 14 is injected into the case main body 2*a* and set therein, so that the transformer 1 is electrically insulated from and fixedly secured to the case main body 2*a* through the insulating resin 14.

Finally, the plug boot 10 with the spring 12 inserted into the through hole 11 is assembled with the high voltage tower 2*b*, thereby completing the assembly of the ignition apparatus.

In this ignition apparatus, an electric signal arithmetically processed by an engine control unit (not shown) is sent to an igniter (not shown) through a connector 8. Thereafter, an excitation current to the primary winding 4 is controlled by the igniter, so that a high voltage is impressed to the high voltage output terminal 7 to cause a discharge in a gap portion of the spark plug 13.

According to the ignition apparatus as constructed above, one pair of protrusions 20 for limiting or restricting the rotation of the case main body 2*a* around the axis of the plug hole 15 are formed on the one side surface of the case main body 2*a* in opposition to the wall portions 22. As a result, the clockwise and counterclockwise rotation of the ignition apparatus with respect to the internal combustion engine main body 16 upon mounting of the ignition apparatus thereon can be restricted with a simple structure, whereby the connector 8 can be aligned or positioned in place in a predetermined direction with ease.

In addition, the ignition apparatus can be mounted on the internal combustion engine without the outer periphery of the case main body 2*a* being damaged due to the rotation thereof, so it is possible to prevent reduction in the dielectric strength of the ignition apparatus due to the damage that might otherwise be caused.

Further, the protrusions 20, being formed integrally with the case 1, can be formed at low cost without the addition of new parts.

Embodiment 2

Figure 4:
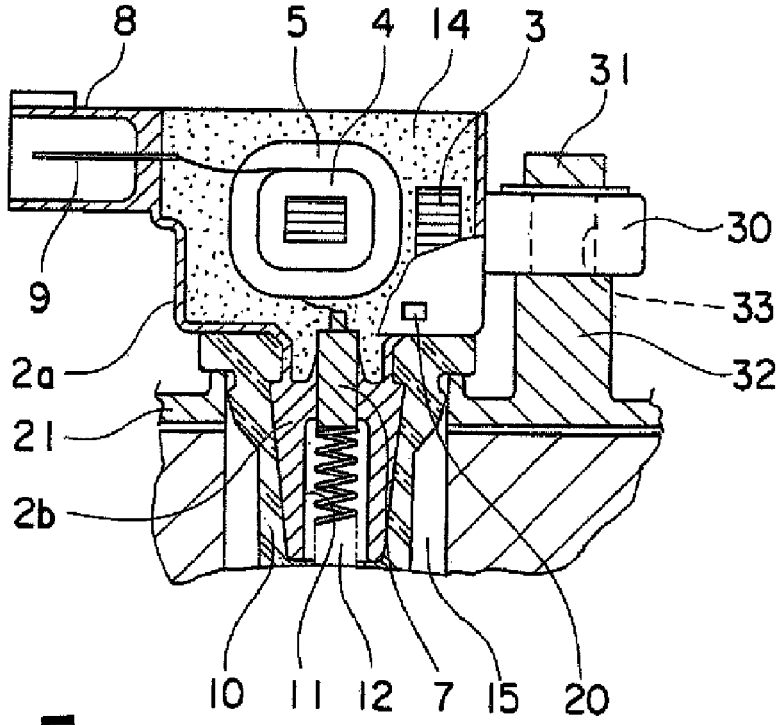
FIG. 4 is a partial cross sectional front elevational view showing an ignition coil apparatus for an internal combustion engine according to a second embodiment of the present invention.
Figure 5:
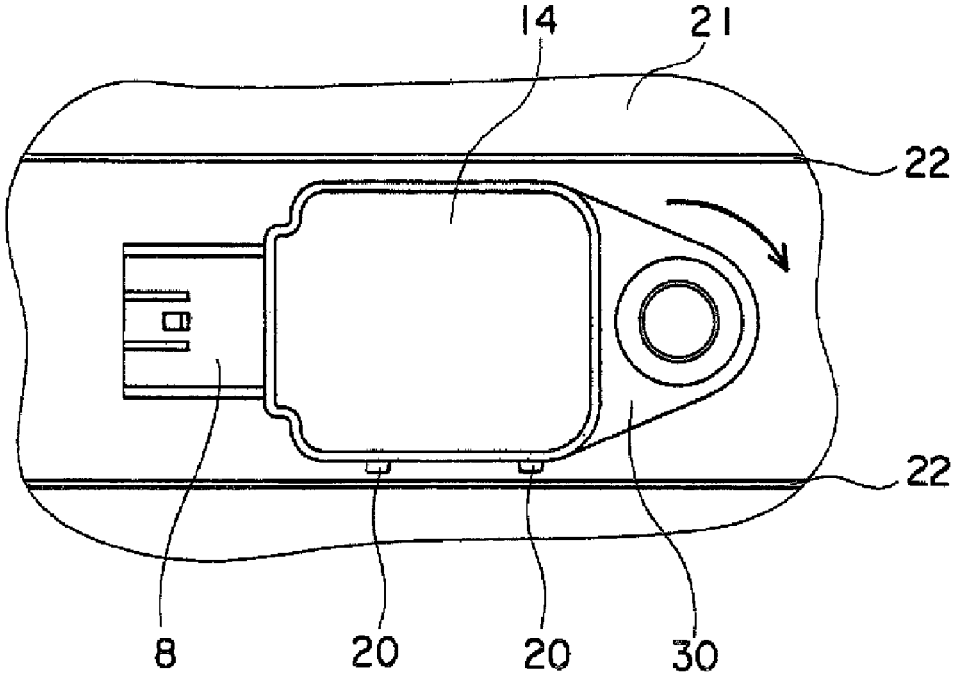
FIG. 5 is a plan view showing the ignition coil apparatus for an internal combustion engine in FIG. 4.

FIG. 4 is a partial cross sectional front elevational view that shows an ignition apparatus for an internal combustion engine according to a second embodiment of the present invention. FIG. 5 is a plan view that shows the ignition apparatus in FIG. 4.

In this second embodiment of the present invention, a mounting flange 30 protruding from an intermediate portion of a case main body 2*a* in a diametrical direction is formed integrally with the case main body 2*a*. A hole 33 through which a bolt 31 acting as a fastening element extends is formed in the mounting flange 30.

In addition, a head cover 21 is formed with a column member 32, which has a threaded hole formed therein into which the bolt 31 is threadedly engaged. The other construction of this second embodiment is similar to that of the first embodiment.

In the ignition apparatus according to this second embodiment, i.e., in the ignition apparatus of the type in which an igniter is fixedly secured to the head cover 21 by means of the bolt 31, the clockwise and counterclockwise rotation of the ignition apparatus upon mounting thereof on the internal combustion engine is limited or restricted by cooperation of the protrusions 20 and the wall portions 22.

Accordingly, the axis of the hole 33 in the mounting flange 30 and the axis of the threaded hole in the column member 32 can be easily aligned with each other, and the rotation of the ignition coil in a direction indicated by an arrow in FIG. 5 during the fastening operation can be prevented, whereby the efficiency in mounting operation of the ignition apparatus with respect to the internal combustion engine can be improved.

Embodiment 3

Figure 6:
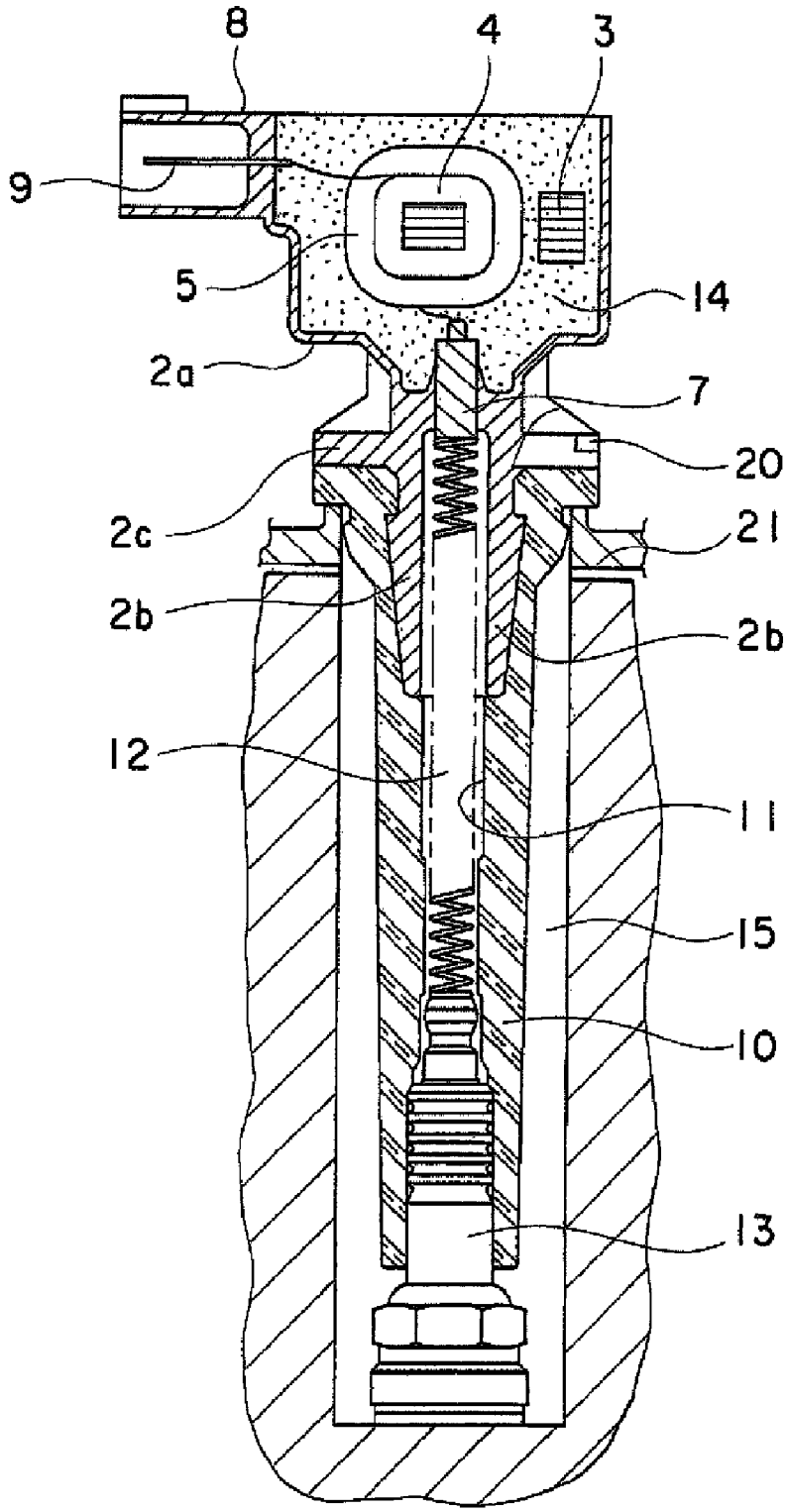
FIG. 6 is a cross sectional front elevational view showing an ignition coil apparatus for an internal combustion engine according to a third embodiment of the present invention.
Figure 7:
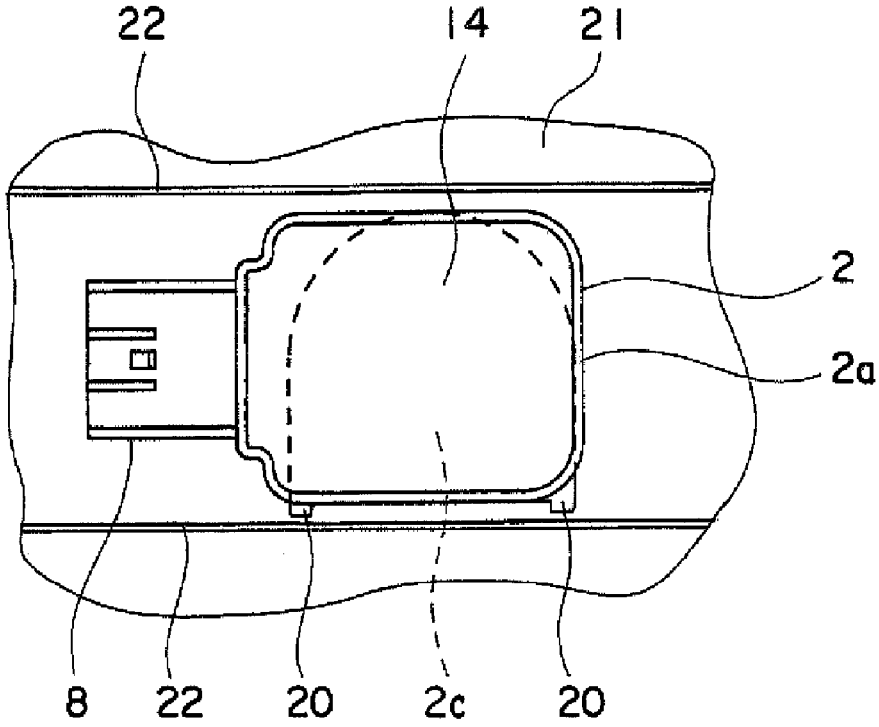
FIG. 7 is a plan view showing the ignition coil apparatus for an internal combustion engine in FIG. 6.
Figure 8:
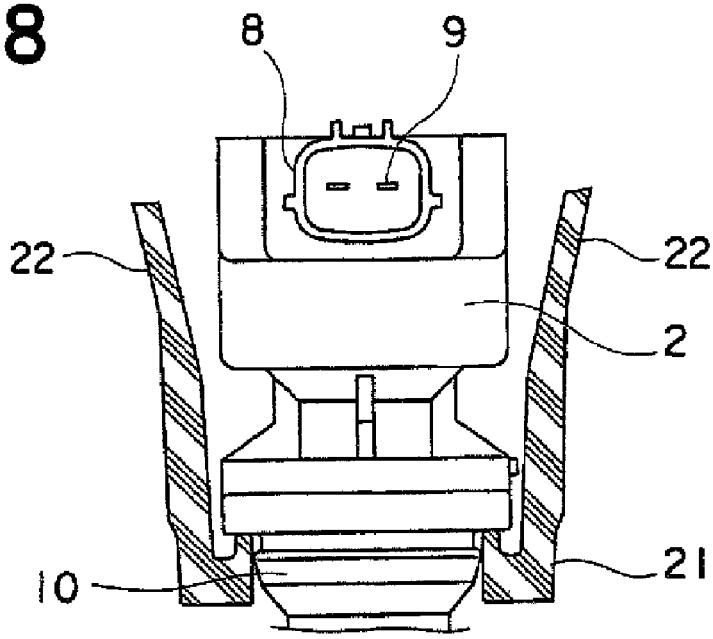
FIG. 8 is a partial left-side view of the ignition coil apparatus for an internal combustion engine in FIG. 6.

FIG. 6 is a front elevational view that shows an ignition apparatus according to a third embodiment of the present invention. FIG. 7 is a plan view that shows the ignition apparatus in FIG. 6, and FIG. 8 is a partial left-side view of the ignition apparatus in FIG. 6.

In the third embodiment of the present invention, a spacer flange 2*c* protruding in a diametrical direction is formed integrally with a case main body 2*a* and a high voltage power 2*b* at a location therebetween.

The spacer flange 2*c* cooperates with a head cover 21 to clamp an end of a plug boot 10 therebetween. A pair of protrusions 20 are formed on a surface of the spacer flange 2*c* in opposition to a pair of wall portions 22. The other construction of this third embodiment is similar to that of the first embodiment.

According to the ignition apparatus of this third embodiment, the protrusions 20 are formed on the surface of the spacer flange 2*c* at a location spaced from the transformer 1, whereby a safer distance can be ensured from the head cover 21 which acts as a GND band, and the degradation of the insulating resin 14 due to a corona discharge can be reduced.

In addition, due to the provision of the spacer flange 2*c*, the distance between the case main body 2*a* and the internal combustion engine becomes large, so the degradation of the insulating resin 14 due to the heat received from the internal combustion engine can be reduced.

Embodiment 4

Figure 9:
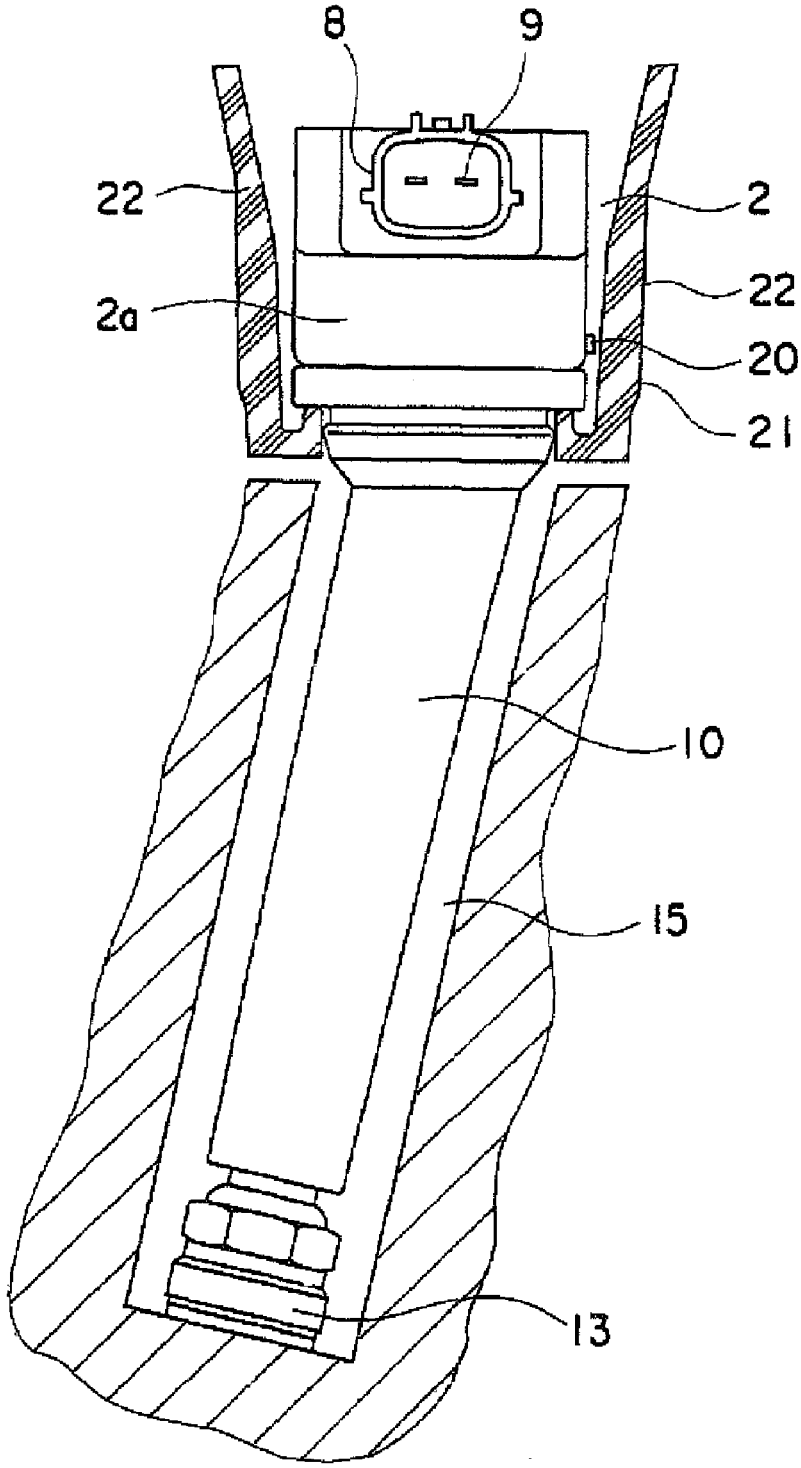
FIG. 9 is a front elevational view showing an ignition coil apparatus for an internal combustion engine according to a fourth embodiment of the present invention.
Figure 10:
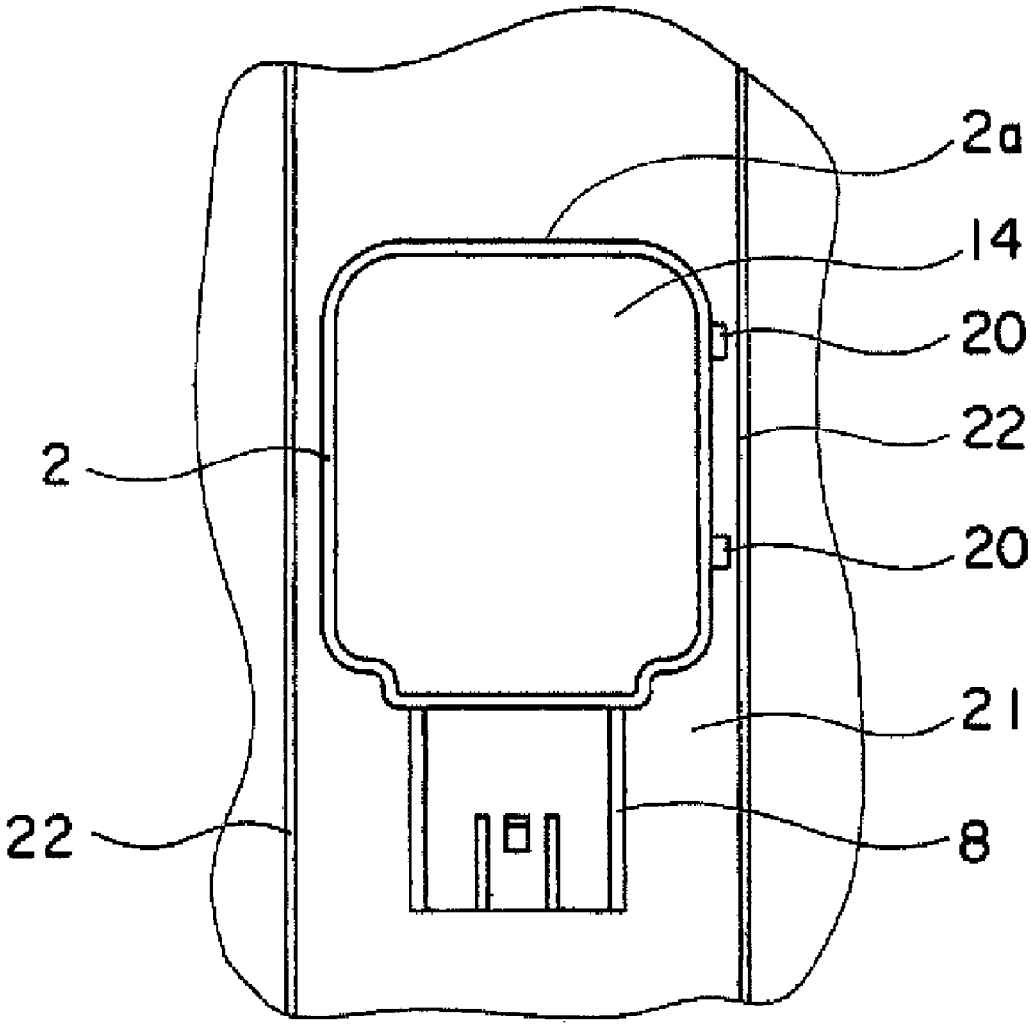
FIG. 10 is a plan view showing the ignition apparatus for an internal combustion engine in FIG. 9.

FIG. 9 is a front elevational view that shows an ignition apparatus according to a fourth embodiment of the present invention. FIG. 10 is a plan view that shows the ignition apparatus in FIG. 9.

The ignition apparatus according to this fourth embodiment is mounted on an internal combustion engine by inserting a plug boot 10 into a plug hole 15 which is arranged in a state inclined with respect to a vertical line of an internal combustion engine main body 16.

This ignition apparatus can also be applied to such an internal combustion engine with the plug hole 15 arranged in an inclined manner, and the rotation of the ignition apparatus upon mounting thereof on the internal combustion engine can be restricted with a simple structure.

Although in the above-mentioned respective embodiments, reference has been made to the ignition apparatuses having a rectangular shape when the case may body 2*a* is viewed in its axial direction, the present invention can also be applied to an ignition apparatus that has a case main body of a circular shape, and in case where the invention is applied to such an ignition apparatus, the effect of restricting the rotation of the ignition apparatus is great.

In addition, in case where the ignition apparatus is mounted on the internal combustion engine with the case main body 2*a* and the wall portions 22 being spaced a large distance from each other, the length of the protrusions 20 need be long enough to restrict the rotation of the initial apparatus.

Moreover, the protrusions 20 may be formed on the opposite side surfaces of the casing main body 2*a* along a diagonal line, thereby restricting the clockwise and counterclockwise rotation of the ignition apparatus.

Further, by placing the protrusions 20 in abutting engagement with the wall portions 22, the protrusions 20 may have the function of positioning the ignition apparatus with respect to the head cover 21.

While the invention has been described in terms of preferred embodiments, those skilled in the art will recognize that the invention can be practiced with modifications within the spirit and scope of the appended claims.

What is claimed is:

1. An ignition coil apparatus for an internal combustion engine comprising:

a transformer having a primary winding, a secondary winding and an iron core;

a case main body with said transformer received therein;

a high voltage tower that is formed integrally with said casing main body, and holds therein a high voltage output terminal for outputting a high voltage generated upon interruption of an excitation current flowing through said primary winding to the outside; and a cylindrical plug boot that has one end attached to said high voltage tower;

wherein said plug boot is mounted on an internal combustion engine main body through a head cover having upstanding wall portions by being inserted into a plug hole formed in said internal combustion engine main body; and a pair of protrusions for restricting the rotation of said casing main body around an axis of said plug hole are formed on a surface of said casing main body in opposition to said wall portions.

2. The ignition coil apparatus for an internal combustion engine as set forth in claim 1, wherein a mounting flange fixedly secured to a column member of said head cover by means of a fastening element is formed integrally with said case main body so as to protrude therefrom in a diametrical direction.

3. The ignition coil apparatus for an internal combustion engine as set forth in claim 1, wherein a spacer flange protruding in a diametrical direction is formed integrally with said case main body and said high voltage power at a location therebetween, and said spacer flange cooperating with said head cover to clamp one end of said plug boot therebetween is formed with said protrusions.

4. The ignition coil apparatus for an internal combustion engine as set forth in claim 1, said plug boot is inserted into said plug hole that is inclined with respect to a vertical line of said internal combustion engine main body.

* * * * *